US010786100B2

(12) United States Patent
Glavin

(10) Patent No.: US 10,786,100 B2
(45) Date of Patent: Sep. 29, 2020

(54) GIRTH-ADJUSTABLE SLEEPING BAG

(71) Applicant: Zenbivy LLC, Spokane, WA (US)

(72) Inventor: Michael Glavin, Spokane, WA (US)

(73) Assignee: ZENBIVY LLC, Spokane, WA (US)

( * ) Notice: Subject to any disclaimer, the term of this patent is extended or adjusted under 35 U.S.C. 154(b) by 276 days.

(21) Appl. No.: 15/865,233

(22) Filed: Jan. 8, 2018

(65) Prior Publication Data

US 2018/0192796 A1 Jul. 12, 2018

Related U.S. Application Data

(60) Provisional application No. 62/444,228, filed on Jan. 9, 2017.

(51) Int. Cl.
*A47G 9/08* (2006.01)

(52) U.S. Cl.
CPC ..... *A47G 9/08* (2013.01); *A47G 9/086* (2013.01)

(58) Field of Classification Search
CPC ..... A47G 9/08; A47G 9/083; A47G 9/086; A47G 9/023; A47G 9/066; A47G 9/064; A47G 9/068; A47G 9/0223; A47G 9/0215; A47G 9/0284; A47G 9/0276; A47G 9/0207
See application file for complete search history.

(56) References Cited

U.S. PATENT DOCUMENTS 3,178,734 A * 4/1965 Carrez Daniel ..... A47G 9/02 5/413 R
3,857,124 A * 12/1974 Hadley ..... A47C 21/022 5/496

(Continued)

FOREIGN PATENT DOCUMENTS

| | | |
|---|---|---|
| CN | 203059105 U | 7/2013 |
| CN | 104921527 | 9/2015 |
| KR | 10-2004-0100133 | 12/2004 |

OTHER PUBLICATIONS

International Search Report dated Apr. 11, 2018 in co-owned counterpart App No. PCT/US2018/012848.
Notification of First Office Action for China Application No. 2018800063223 dated May 13, 2020; 28 pp.

* cited by examiner

*Primary Examiner* — Peter M. Cuomo
*Assistant Examiner* — Ifeolu A Adeboyejo
(74) *Attorney, Agent, or Firm* — Armstrong Teasdale LLP

(57) ABSTRACT

A sleeping bag includes a top cover and bottom sheet. The bottom sheet can be secured to a sleeping pad and includes a sheet portion and lateral flaps connected to the sheet portion along opposite lateral edges of the sleeping pad when the bottom sheet is secured thereto. The top cover and lateral flaps enable attachment, detachment, and reattachment of the lateral flaps along their lateral edges to a top cover outer surface along corresponding attachment paths displaced medially from top cover lateral edges, enabling a top cover headward portion to assume wrapped and expanded configurations, and enabling conversion between those configurations. When wrapped, headward portions of the top cover outer surface, that are lateral of the attachment paths, are positioned against the sheet portion; when expanded, the lateral flaps and lateral portions of the top cover extend upward or laterally away from the sleeping pad lateral edges.

21 Claims, 6 Drawing Sheets

(56) References Cited

U.S. PATENT DOCUMENTS

| | | | | | |
|---|---|---|---|---|---|
| 4,301,561 | A * | 11/1981 | McLeod | A47C 21/022 | 5/496 |
| 5,193,235 | A * | 3/1993 | Kircher | A47G 9/086 | 5/413 R |
| 5,386,602 | A * | 2/1995 | Krenzler | A47G 9/086 | 2/69.5 |
| 5,735,003 | A * | 4/1998 | Judge | A47G 9/086 | 5/413 AM |
| 6,018,830 | A | 2/2000 | Howe | | |
| 6,490,741 | B1 * | 12/2002 | Wheeler | A47G 9/02 | 5/494 |
| 6,513,164 | B1 * | 2/2003 | Hearns | A41B 13/06 | 2/69.5 |
| 8,453,280 | B2 * | 6/2013 | Martray | A47G 9/086 | 5/413 AM |
| 9,101,233 | B2 | 8/2015 | Benninger | | |
| 9,523,165 | B2 * | 12/2016 | Crispino | D05B 19/02 | |
| 2010/0251482 | A1 * | 10/2010 | MacDonald | A47G 9/02 | 5/494 |
| 2011/0113550 | A1 * | 5/2011 | Lafoux | A47G 9/086 | 5/413 R |
| 2011/0173749 | A1 | 7/2011 | Martray | | |
| 2019/0183252 | A1 * | 6/2019 | Liu | A47G 9/02 | |

GIRTH-ADJUSTABLE SLEEPING BAG

BENEFIT CLAIM TO RELATED APPLICATION

This application claims benefit of U.S. provisional App. No. 62/444,228 filed Jan. 9, 2017 in the name of Michael Glavin, said provisional application being hereby incorporated by reference as if fully set forth herein.

FIELD OF THE INVENTION

The field of the present invention relates to sleeping bags. In particular, examples of a girth-adjustable sleeping bag and of methods of use thereof are disclosed.

BACKGROUND

A variety of conventional sleeping bags exist, including rectangular sleeping bags, semi-rectangular sleeping bags, and mummy-type sleeping bags. Larger bags are more comfortable and allow more freedom of movement, but smaller bags are more thermally efficient due to a smaller interior volume that must be heated by the user's body heat. A user is therefore forced to compromise, or to acquire multiple different bags suitable for different temperature conditions; a given conventional sleeping bag cannot be readily adapted to even a moderate range of temperature conditions. Even if a larger bag is suitable for the temperature conditions, a sleeping bag is still more restrictive and less comfortable than traditional bedding, and does not readily accommodate a full range of different sleeping positions.

A sleeping bag is typically used in conjunction with a sleeping pad. Movement of the user while sleeping can result in the user in the sleeping bag rolling or sliding off of the sleeping pad. The sleeping pad typically provides at least some degree of thermal insulation under the sleeper, which is well, because the compressible insulation of the sleeping bag loses its thermally insulating properties when compressed by the weight of the user. The weight of the sleeping bag insulation that ends up beneath the user is effectively dead weight.

SUMMARY

An inventive sleeping bag comprises a top cover and a bottom sheet. The bottom sheet is structurally arranged so as to be secured to a sleeping pad. The bottom sheet includes a sheet portion and a pair of flexible opposing lateral flaps connected along corresponding medial edges thereof to the sheet portion so that, with the bottom sheet secured to the sleeping pad, the lateral flaps are positioned along corresponding opposite lateral edges of the sleeping pad. The top cover and the pair of lateral flaps are structurally arranged so as to enable attachment, detachment, and reattachment of each lateral flap along a corresponding lateral edge thereof to an outer surface of the top cover along a corresponding curved or linear attachment path displaced medially from a corresponding lateral edge of the top cover. Such placement of the attachments paths on the top cover enables a headward portion of the top cover (extending in a headward direction from footward ends of the lateral flaps) to assume wrapped and expanded configurations, and enables a user occupying the sleeping bag to convert between the wrapped and expanded configurations. In the wrapped configuration, the headward portion of the top cover is arranged with portions of the top cover outer surface, that are disposed laterally relative to the attachment paths, positioned against the sheet portion of the bottom sheet; in the expanded configuration, each one of the lateral flaps, and laterally disposed portions of the top cover, are arranged to extend upward or laterally away from the corresponding lateral edges of the sleeping pad.

Objects and advantages pertaining to sleeping bags may become apparent upon referring to the example embodiments illustrated in the drawings and disclosed in the following written description or appended claims.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

The embodiments depicted are shown only schematically; all features may not be shown in full detail or in proper proportion, certain features or structures may be exaggerated relative to others for clarity, and the drawings should not be regarded as being to scale. The embodiments shown are only examples; they should not be construed as limiting the scope of the present disclosure or appended claims.

DETAILED DESCRIPTION OF EMBODIMENTS

For purposes of the present disclosure and appended claims, the terms top, bottom, up, down, above, below, and so forth are defined relative to a generally horizontal surface (e.g., the ground) on which a sleeping pad 100 and the inventive sleeping bag are positioned for a user to occupy the sleeping bag. For purposes of the present disclosure and appended claims, the terms "headward" and "footward" designate opposite longitudinal directions along the length of the inventive sleeping bag or its components, with headward indicating the direction toward which the head of a user occupying the sleeping bag typically would be positioned, and footward indicating the opposite direction, toward which the feet of the user occupying the sleeping bag typically would be positioned. For purposes of the present disclosure and appended claims, "transverse" indicates directions generally horizontal and generally orthogonal to the headward/footward directions. For purposes of the present disclosure and appended claims, "lateral" indicates a position along a structure or object that is located farther transversely from a longitudinal midline of the sleeping bag, while "medial" indicates a position along the structure or object that is located closer transversely to the longitudinal midline of the sleeping bag. For purposes of the present disclosure and appended claims, movement or conversion "between" a first configuration or arrangement and a second configuration or arrangement includes both (i) movement or conversion from the first configuration or arrangement to the second configuration or arrangement and (ii) movement or conversion from the second configuration or arrangement to the first configuration or arrangement.

Figures 1A, 1B, 1C:
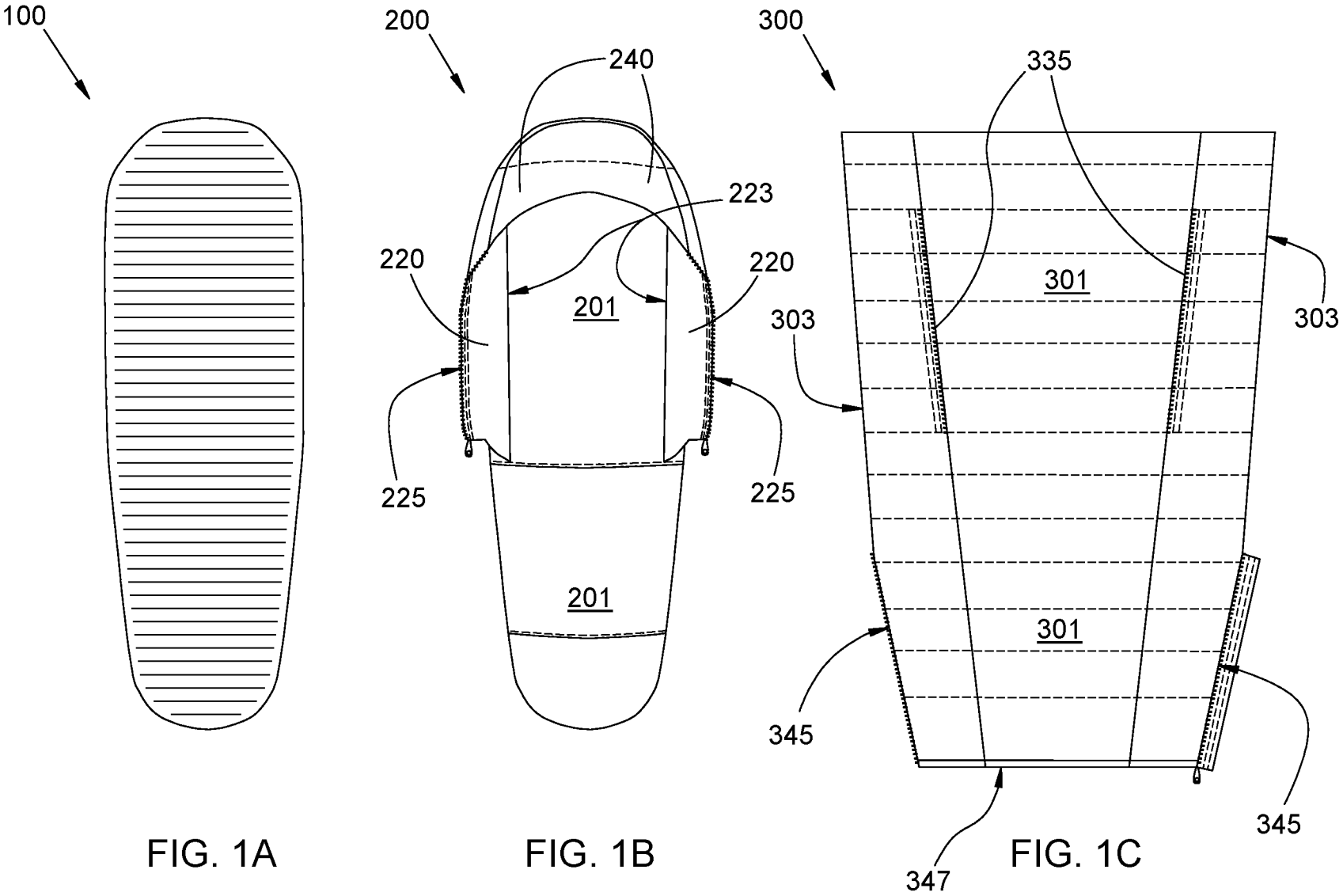
FIGS. 1A, 1B, and 1C are schematic top views of examples of a sleeping pad, a bottom sheet, and a top cover, respectively. An inventive sleeping bag includes a bottom sheet and a top cover; a sleeping pad can be included as well, or provided separately.
Figure 5:
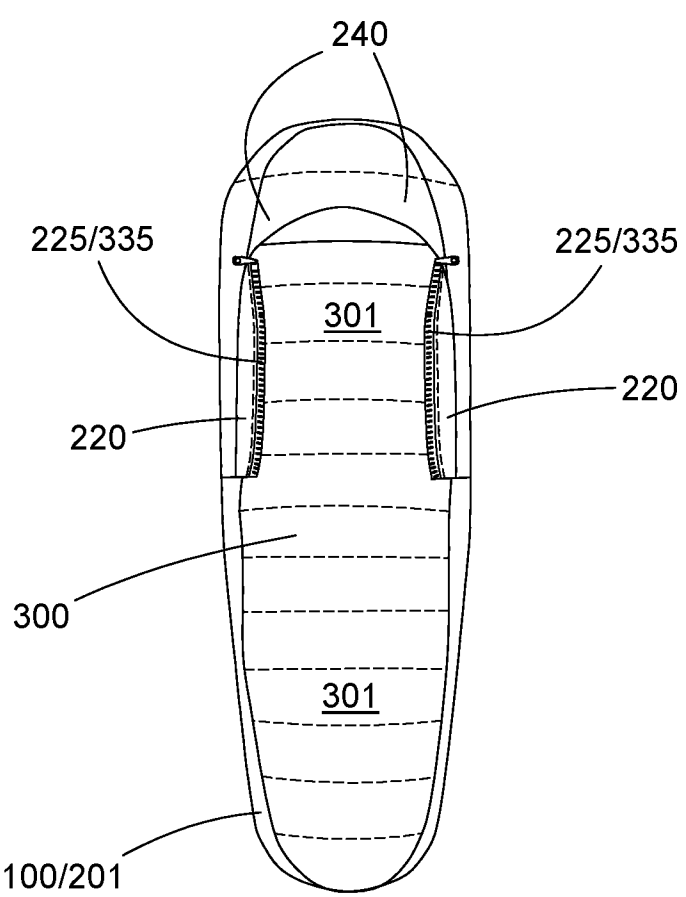
FIGS. 4 and 5 are schematic top views of an example of an inventive sleeping bag.
Figure 7:
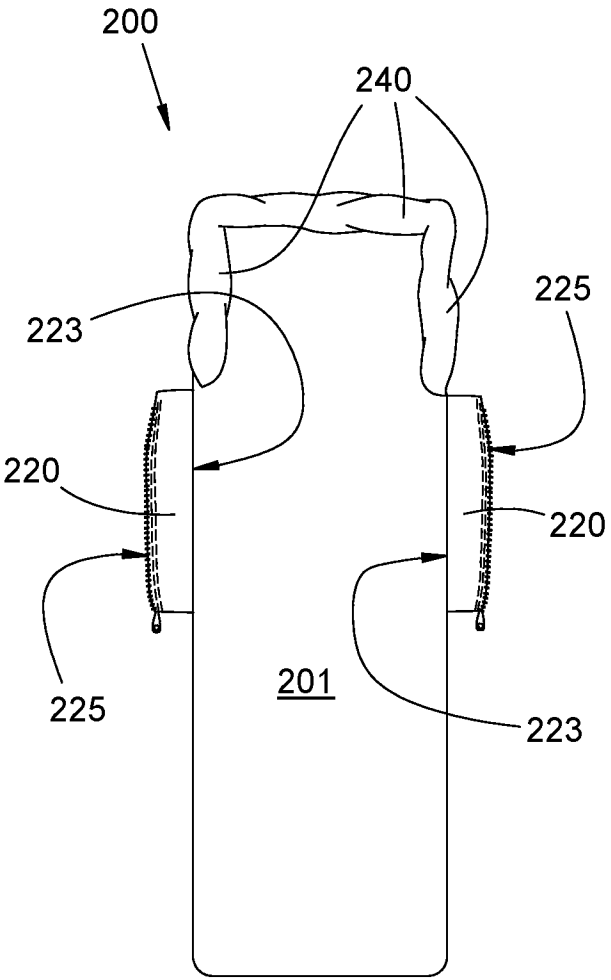
FIGS. 6 and 7 are schematic top views of other examples of a sleeping pad and a bottom sheet.

An example of an inventive sleeping bag is shown in FIGS. 1B and 1C and comprises a top cover 300 and a bottom sheet 200; an inventive sleeping bag can further include a sleeping pad 100 (e.g., as shown in FIG. 1A), or a sleeping pad can be provided separately. In U.S. App. No. 62/444,228 cited above, the top cover 300 is referred to as a quilt or comforter, and the bottom sheet 200 is referred to simply as a sheet. The top cover 300 can be arranged to act as a thermal insulator or can include any suitable or desired insulating material. The bottom sheet 200 is structurally arranged so as to be secured to the sleeping pad 100, and includes a sheet portion 201 and a pair of flexible opposing lateral flaps 220, which are each connected along their corresponding medial edges 223 to the sheet portion 201. In U.S. App. No. 62/444,228, the sleeping pad 100 is also referred to as a mattress, and the lateral flaps 220 are referred to as hinges or hinge elements. With the bottom sheet 200 secured to the sleeping pad 100 (e.g., as in FIGS. 2 and 8), the lateral flaps 220 are positioned along corresponding opposite lateral edges of the sleeping pad 100. Attachment "along" a lateral edge of the sleeping pad 100 can denote attachment directly on the lateral edge (e.g., as in FIGS. 7 and 8), or attachment generally paralleling the lateral edge but displaced only slightly medially (e.g., as in FIGS. 1B and 5). "Generally paralleling" can include deviation up to, e.g., about 5° or about 10° from parallel to the lateral edge; displaced "slightly medially" can include medial displacement from the lateral edge of up to, e.g., about 1 inch, about 2 inches, about 3 inches, or about 5 inches. Attachment can be by sewing, adhering, thermal or ultrasonic bonding or welding, or any other suitable attachment method. Suitable materials for forming the lateral flaps 220 can include one or more of stretchable materials, non-stretchable materials, thermally insulating materials, or non-insulating materials. In some examples, the lateral flaps 220 and the sheet portion 201 can comprise the same one or more materials. In the inventive sleeping bag, the transverse distance along each lateral flap 220 between its medial and lateral edges 223 and 225 (i.e., the flap width) is greater than or about equal to 4 inches, and can be greater than or about equal to 5 inches, greater than or about equal to 6 inches, greater than or about equal to 7 inches, greater than or about equal to 9 inches, greater than or about equal to 11 inches, or even larger. In some examples the flap width is substantially constant along the length of the lateral flap 220 (i.e., the flap length); in other examples the flap width can vary along the flap length, e.g., monotonically increasing or decreasing with increasing footward distance along the flap length, or exhibiting some more complicated width variation along the flap length. A given flap width variation (or lack thereof) can be selected to provide desired fit characteristics for the inventive sleeping bag.

The top cover 300 and the pair of lateral flaps 220 are structurally arranged so as to enable attachment, detachment, and reattachment of each lateral flap 220 along its corresponding lateral edge 225 to the outer surface 301 of the top cover 300. The lateral edge 225 of each lateral flap 220 is attached to the top cover 300 along a corresponding curved or linear attachment path 335 along the outer surface 301 of the top cover 300. The outer surface 301 is the surface of the top cover 300 that faces generally away from a user occupying the sleeping bag, while the inner surface 302 is the surface of the top cover 301 that faces generally toward the user occupying the sleeping bag. Each attachment path 335 is displaced medially from a corresponding lateral edge 303 of the top cover 300. The medial displacement of the attachment paths 335 in the inventive sleeping bag is greater than or about equal to 4 inches, and can be greater than or about equal to 5 inches, greater than or about equal to 6 inches, greater than or about equal to 7 inches, greater than or about equal to 9 inches, greater than or about equal to 11 inches, or even larger. Such large medial displacements of the attachment paths 335 from the lateral edges 303 of the top cover 300 are substantially larger than a displacement resulting from use of a typical zipper baffle such as might be employed with an edge zipper (e.g., typically less than about 2 or 3 inches of displacement of the edge zipper from a corresponding edge; an example of a typical zipper baffle is shown on the lower right edge 345 of the top cover 300 in FIG. 1C).

The relatively large medial displacement (e.g., greater than or about equal to 4 inches or more, as noted above) of the attachment paths 335 from the corresponding lateral edges 303 of the top cover 300, and the transverse distance across each lateral flap 220 (e.g., flap width greater than or about equal to 4 inches or more, as noted above), enable the inventive sleeping bag (with the bottom sheet 200 secured to the sleeping pad 100, and with the lateral flaps 220 attached to the top cover 300 along the attachment paths 335) to assume different arrangements according to the desires of a user occupying the sleeping bag, and to be converted between those different arrangements while the user occupies the sleeping bag. A headward portion the top cover 300 (i.e., that portion extending in a headward direction from footward ends of the attachment paths 335 and the attached lateral flaps 220) can assume both wrapped and expanded configurations, and can be converted between those configurations while the user occupies the sleeping bag.

Figure 4:
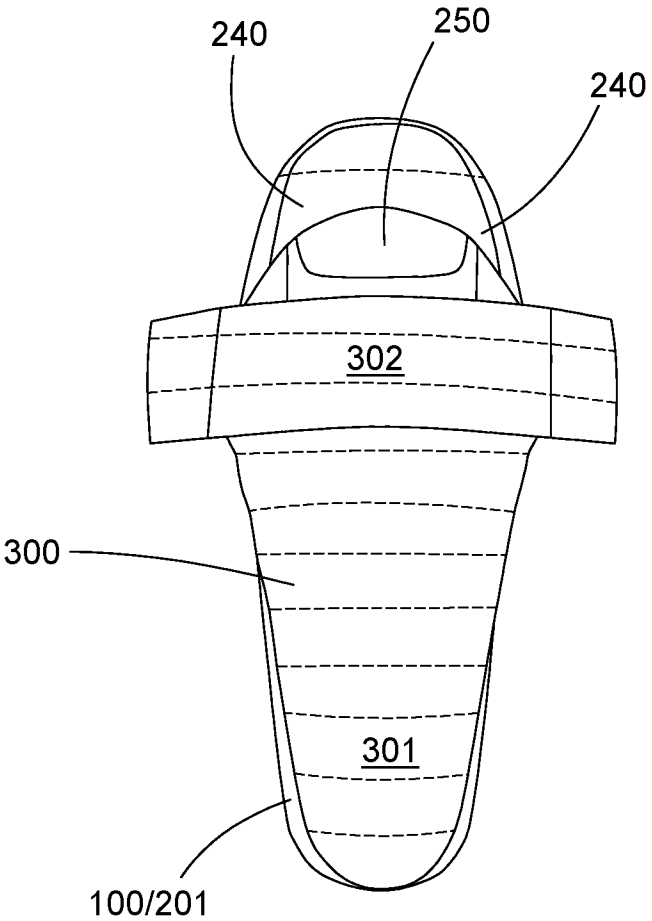
Figure 9A:
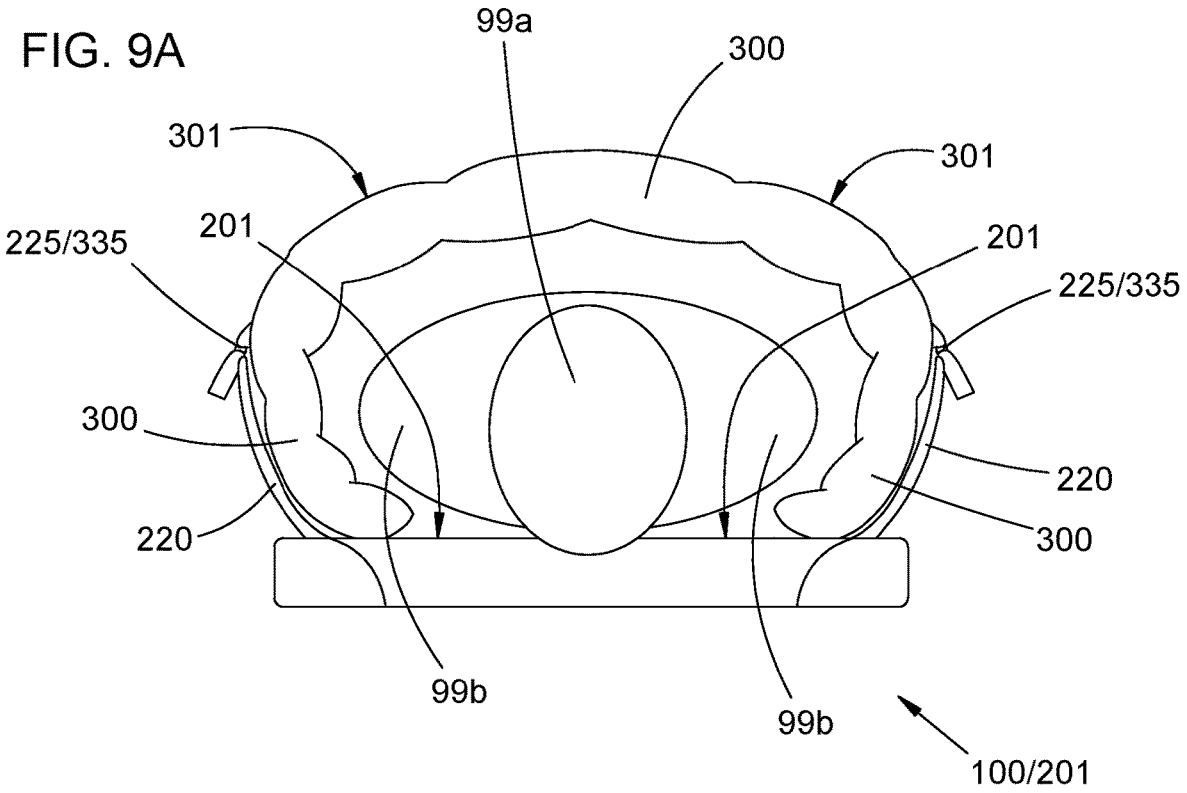
FIGS. 9A and 9B illustrate schematically a user occupying an example of an inventive sleeping bag while lying on his or her back with the top cover in expanded and wrapped configurations, respectively.
Figure 9B:
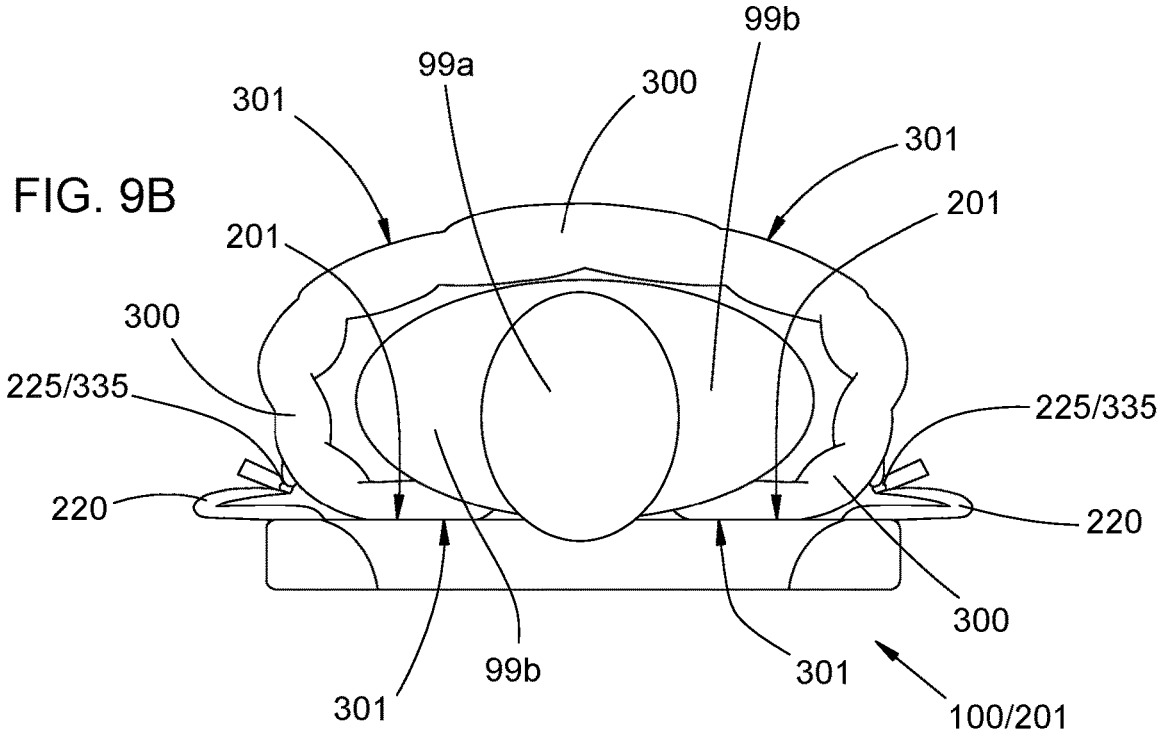
Figure 10A:
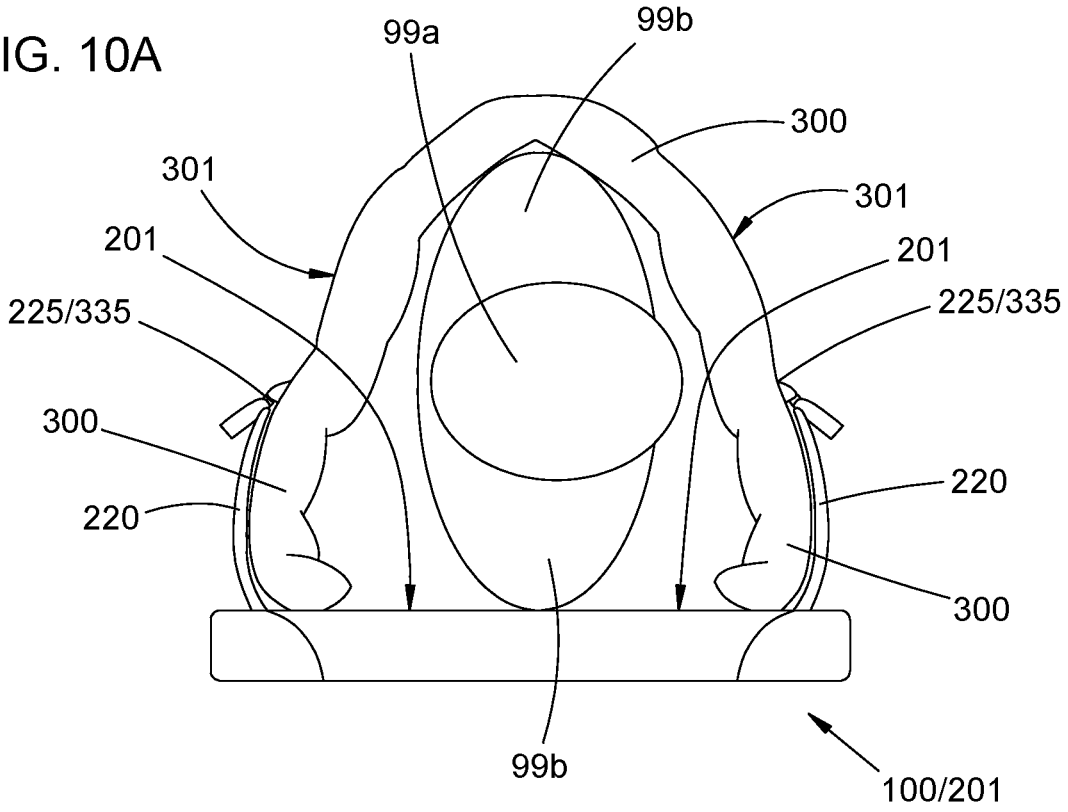
FIGS. 10A and 10B illustrate schematically a user occupying an example of an inventive sleeping bag while lying on his or her side with the top cover in expanded and wrapped configurations, respectively.
Figure 10B:
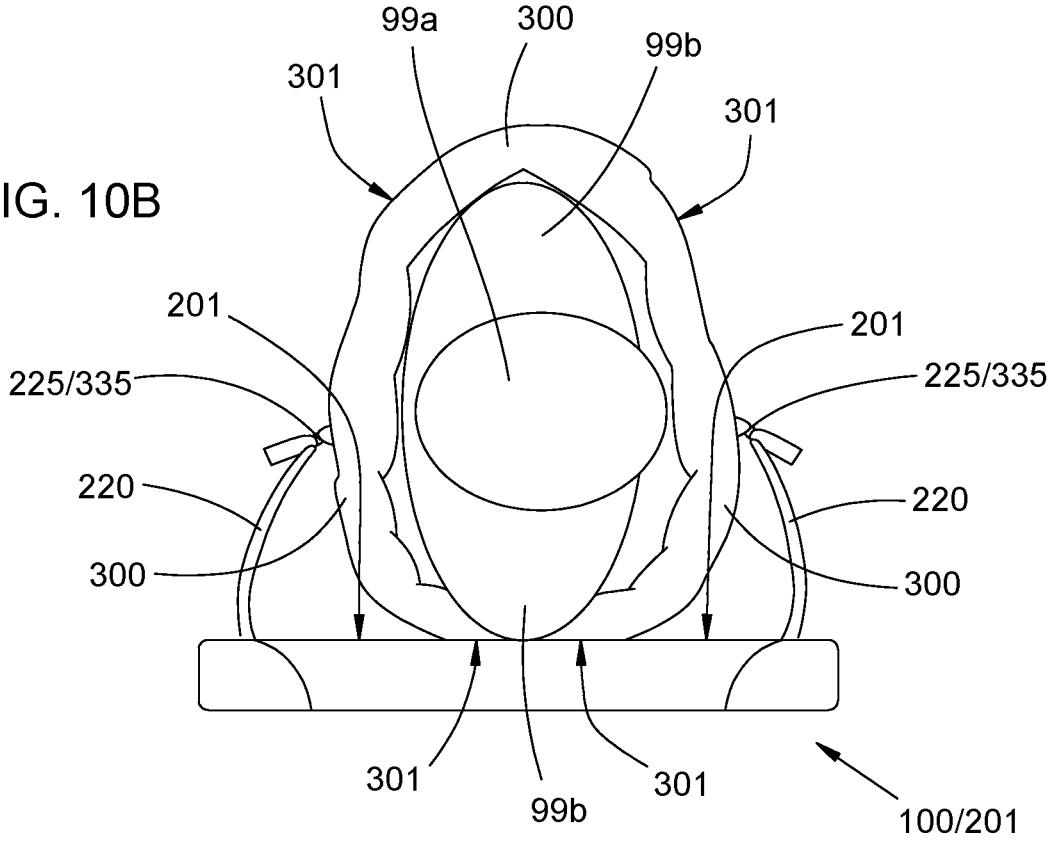

FIGS. 9A/9B and 10A/10B are schematic views in a footward direction from the headward end of the inventive sleeping bag occupied by a user having a head 99*a* and torso 99*b*; in FIGS. 9A/9B the user lies on his or her back, while in FIGS. 10A/10B the user lies on his or her side. In the wrapped configuration (e.g., as in FIGS. 5, 9B, and 10B; also referred to as the reduced-girth configuration), the headward portion of the top cover 300 is arranged with portions of the top cover outer surface 301, that are disposed laterally relative to the attachment paths 335, turned under and positioned against the sheet portion 201 of the bottom sheet 200; those lateral, headward portions of the top cover 300 can extend beneath a portion of the torso 99*b* of the user occupying the sleeping bag, and can even overlap one another if wrapped sufficiently tightly. The wrapped configuration might be desirable for a user having a petite or slight build, or to reduce or minimize the interior volume of the sleeping bag to keep the user warmer in colder conditions. In the expanded configuration (as in FIGS. 4, 9A, and 10A; also referred to as increased-girth configuration), each one of the lateral flaps 220, and laterally disposed portions of the top cover 300, extend upward or laterally away from the corresponding lateral edges of the sleeping pad 100. In some examples, little or none of those lateral, headward portions of the top cover 300 remains in contact with the sheet portion 201 of the bottom sheet 200. In some other examples, some lateral, headward portions of the top cover 300 can remain in contact with the sheet portion 201 of the bottom sheet 200 (albeit substantially less than in the wrapped arrangement). The expanded configuration might be desirable for a user having a bulkier build, or to increase or maximize the interior volume of the sleeping bag to adapt to warmer conditions or to allow more freedom of movement or more comfortable sleep for the user occupying the sleeping bag (e.g., on the user's back as in FIGS. 9A/9B or on the user's side as in FIGS. 10A/10B). In many examples, distance along the top cover 301 from each attachment path 335 to the corresponding lateral edge 303 of the top cover 300 typically is greater than, or at least about equal to, distance along each lateral flap 220 from its medial edge to its lateral edge 225. Those relative distances result in the headward portion of the top cover 300 reaching the sleeping pad 100 and the sheet portion 201 of the bottom sheet 200 even when in the expanded configuration, so that the user can be completely encircled by a combination of the headward portion of the top cover 300 and the sheet portion 201 and sleeping pad 100, if desired, thereby maintaining thermal integrity of the sleeping bag.

By enabling conversion between wrapped and expanded configurations, the inventive sleeping bag provides the new and useful result that the sleeping bag can be used comfortably by users of various different builds (e.g., with the headward portion of the top cover 300 in the wrapped configuration for a user with a slender build, or in the expanded configuration for a user with a stout build) or under different temperature conditions (e.g., with the headward portion of the top cover 300 in the wrapped configuration for colder conditions, or in the expanded configuration for warmer conditions or to provide more freedom of movement for the user). A single inventive sleeping bag can take the place of multiple different conventional sleeping bags that are each suitable for only a relatively narrow range of temperature conditions. Conventional sleeping bags of multiple different sizes for accommodating users of different sizes can be replaced by inventive sleeping bags of relatively fewer different sizes, or even only a single size (so-called one-size-fits-all or one-size-fits-most scenarios). Weight can also be reduced relative to a conventional sleeping bag, because a portion of thermally insulating material that would necessarily end up underneath the user in a conventional sleeping bag can be omitted from the inventive sleeping bag, while still providing increased freedom of movement with the top cover in its expanded configuration. The attachment of the top cover 300 to the lateral flaps 220 also serves to prevent, in most instances, the user from sliding or rolling off of the sleeping pad 100; the lateral flaps 220 obstruct such movements of the user.

Figure 6:
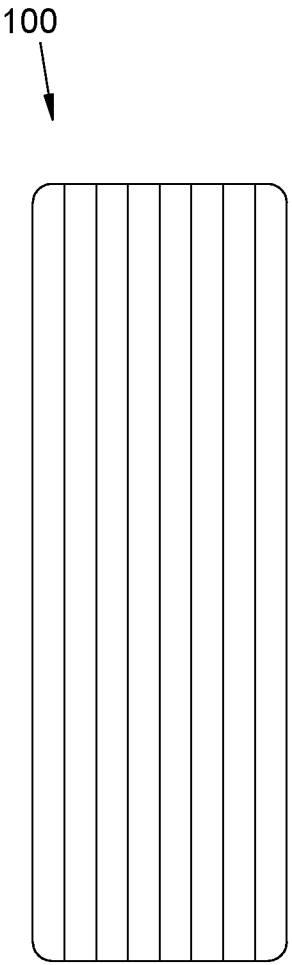

The sleeping pad 100 can be of any suitable type or arrangement, including but not limited to a foam pad or an inflatable pad. Typical widths include widths from about 20 inches to about 30 inches; other suitable widths can be employed outside of that range. Typical lengths includes lengths from about 36 inches to about 80 inches, typically from about 60 inches to about 80 inches for adults; other lengths outside those ranges can be employed. The sleeping pad 100 can act as a thermal insulator or can include any suitable or desired thermally insulating material. The sleeping pad can be roughly rectangular (e.g., as in FIG. 6), or can have a mummy-like shape (i.e., similar to the shape of a conventional mummy-type sleeping bag; e.g., as in FIG. 1A), or can have any other suitable or desired shape. The sheet portion 201 of the bottom sheet 200 is suitably sized and shaped according to the size and shape of the sleeping pad 100 with which it is intended to be used. Typically, the bottom sheet 200 and the sleeping pad 100 are separate articles. In that case the sleeping pad 100 can be one article of a set that also includes the bottom sheet 200 and the top cover 300 of an inventive sleeping bag, or can be an item that is acquired by a user separately from acquiring the inventive sleeping bag. In some other examples, however, the bottom sheet 200 and the sleeping pad 100 can be integrally formed (i.e., the sheet portion 201 forms a surface of the sleeping pad 100, so that the lateral flaps 220 are attached directly to the sleeping pad 100). In that instance, the sleeping pad 100 is necessarily acquired by the user as a part of the inventive sleeping bag.

Figure 2:
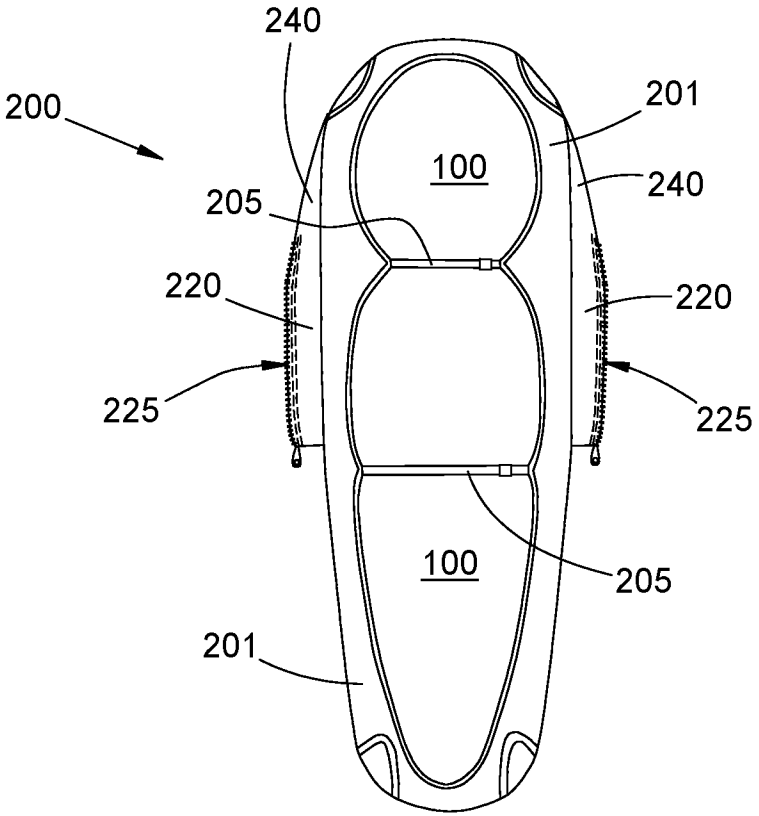
FIG. 2 is a schematic bottom view of the example bottom sheet on the example sleeping pad.
Figure 8:
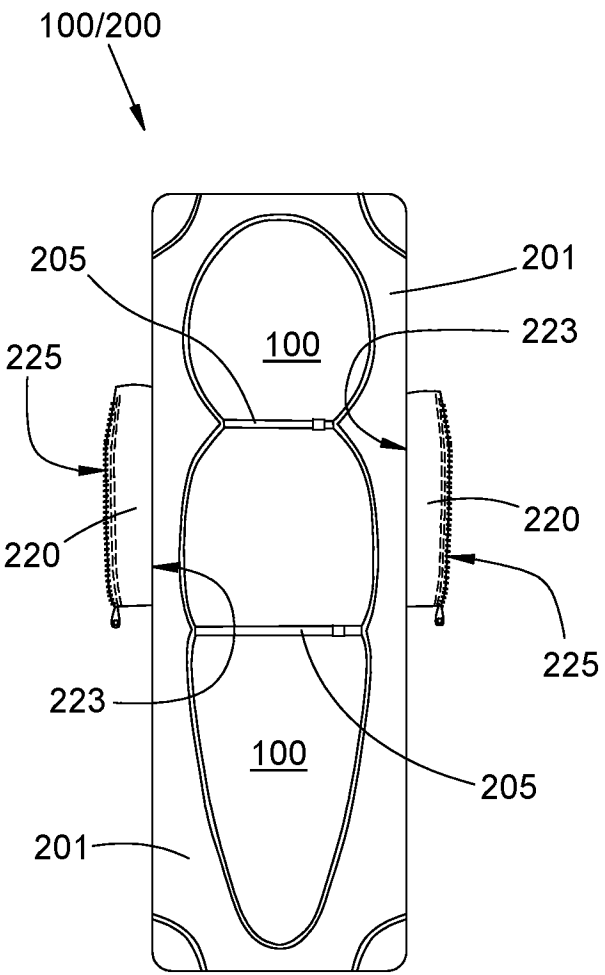
FIG. 8 is a schematic bottom view of the other example bottom sheet on the other example sleeping pad.

In examples wherein the sleeping pad 100 and the bottom sheet 200 are separate articles, the sheet portion 201 of the bottom sheet 200 can be arranged so as to be secured to the sleeping pad 100 in a fitted-sheet arrangement (e.g., as in FIGS. 2 and 8). Accordingly, the sheet portion 201 can include corner pockets or end pockets arranged to receive corresponding portions of the sleeping pad 100 and hold the bottom sheet 200 secured to the sleeping pad 100. In addition to the corner or end pockets, in some examples the sheet portion can include elastic or a draw cord arranged to maintain the sheet portion 201 in the fitted-sheet arrangement. In addition to the corner or end pockets, in other examples the bottom sheet 200 can include one or more straps 205 arranged to maintain the sheet portion in the fitted-sheet arrangement. Each strap 205 can be arranged so that, with sheet portion 201 of the bottom sheet 200 secured to the sleeping pad 100 in the fitted-sheet arrangement, each strap 205 is connected to opposite edges of sheet portion 201 and passes underneath the sleeping pad 100. One or more of the straps 205 can be positioned along the length of the sheet portion 201 so as to fall within the lengthwise span of the lateral flaps 220; thus arranged, the straps 205 are advantageously positioned to prevent tension on the lateral flap 220 from pulling a side edge of the sheet portion 201 off of the sleeping pad 100 as a user-occupant moves around within the sleeping bag. Any suitable or desired number of straps 205 can be employed; two straps 205 are shown in the examples of FIGS. 2 and 8. Instead of (or in addition to) a fitted-sheet arrangement, the bottom sheet 200 can be secured to the sleeping pad 100 in any suitable or desired way, e.g., using zippers, sets of fasteners, or other methods of attachment.

The inventive sleeping bag can be arranged so that, with the bottom sheet 200 secured to the sleeping pad 100, each lateral flap 220 extends in headward and footward directions to any suitable or desired positions along the sleeping pad 100, e.g., over the entire length of the sleeping pad 100 or over only a portion of the length of the sleeping pad 100. In some examples, the footward ends of the lateral flaps 220 extend no further than about a midpoint of the sleeping pad 100 (e.g., extend less than or about equal to 36 inches from the headward end of a 72-inch sleeping pad). In some examples (e.g., as in FIGS. 1B and 7), neither lateral flap 220 extends in a headward direction as far as a headward end of the sleeping pad 100. With the top cover 300 attached to the bottom sheet 200 (by attachment of the lateral edges 225 of the lateral flaps 220 to the attachment paths 335 of the top cover 300), the headward portion of the top cover 300, i.e., the portion of the top cover 300 that can be arranged in the wrapped versus expanded arrangements described above, typically extends only as far footward as the footward ends of the lateral flaps 220, and typically extends headward beyond the headward ends of the lateral flaps 220. The combination of lateral flaps 220 that do not reach the headward end of the sleeping pad 100 and a headward portion of the top cover 300 that extends headward beyond the lateral flaps 220 enables a user occupying the sleeping bag to decide whether or how much to cover the user's arms, shoulders, upper torso, or head. In the example arrangement of FIG. 4 (in which the headward portion of the top cover 300 is in the expanded configuration), a portion of the top cover 300 that extends beyond the lateral flaps 220 is folded footward, so that a headward portion of the top cover inner surface 302 is exposed. In the example arrangement of FIG. 5 (in which the headward portion of the top cover 300 is in the wrapped configuration), the top cover 300 extends headward beyond the lateral flaps 220.

In some examples, the lateral edge 225 of each lateral flap 220 includes a zipper element that mates with a corresponding zipper element arranged along the corresponding attachment path 335 on the top cover 300. Those mating zipper elements enable the attachment, detachment, and reattachment of each lateral flap 220 along its lateral edge 225 to the outer surface 301 of the top cover 300 along the corresponding curved or linear attachment path 335 (typically linear). In some other examples, the top cover 300 and the bottom sheet 200 can include corresponding sets of mating fastener elements arranged along the lateral edges 225 of the lateral flaps 220 and along the attachment paths 335 that enable the attachment, detachment, and reattachment of each lateral flap 220 along its lateral edge 225 to the outer surface 301 of the top cover 300 along the corresponding attachment path 335. Examples of suitable fastener elements can include, e.g., snaps, clasps, hook-and-loop, buttons, ties or laces, and so forth.

Figure 3:
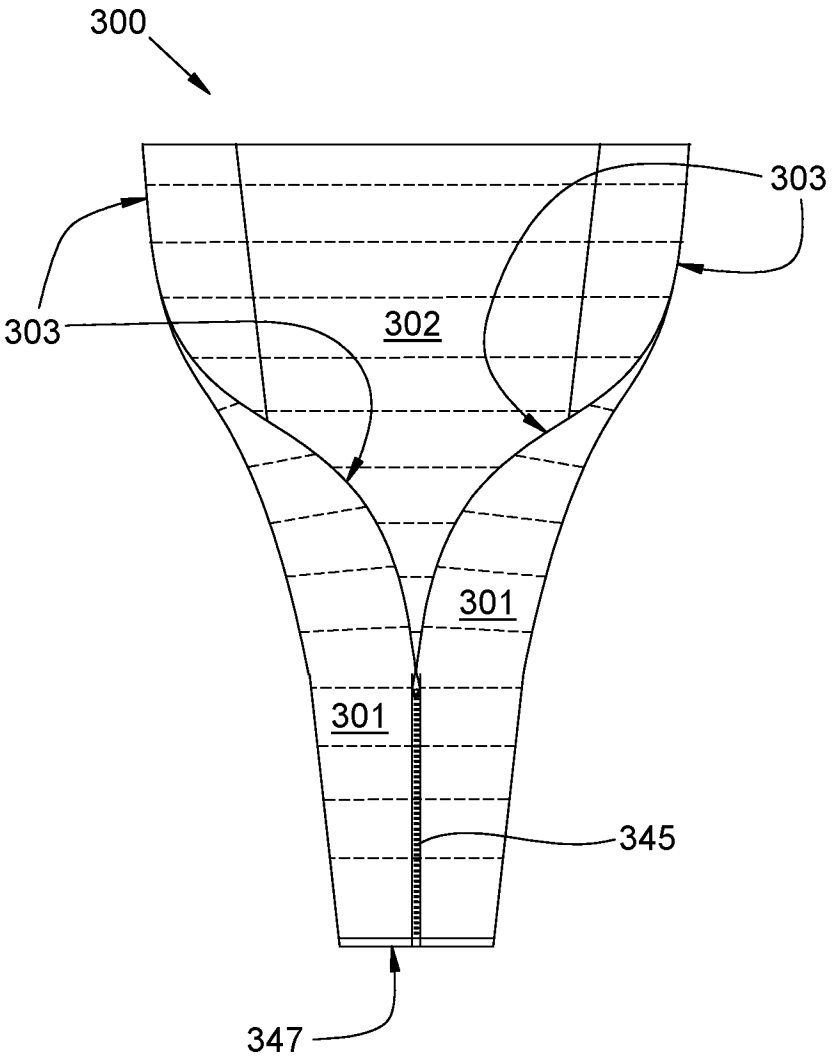
FIG. 3 is a schematic bottom view of the example top cover.

As described above, a headward portion of the top cover 300 can be arranged in the wrapped or expanded configuration; that headward portion extends headward from the footward ends of the attachment paths 335 (and headward from the footward ends of the lateral flaps 220 when the top cover is attached to the bottom sheet 200). In some examples a footward portion of the top cover 300 can be arranged as a closed footbox (i.e., a fixed tubular portion with a fixedly closed end). In other examples, the footward portion of the top cover 300 can also be structurally arranged to assume different configurations according to the needs or desires of a user occupying the sleeping bag. In some examples, the footward portion of the top cover can be structurally arranged to assume a tubular configuration (e.g., as in FIG. 3 through 5); corresponding footward portions 345 of the opposite lateral edges 303 of the top cover 300 can be secured together to form the tubular configuration. The footward portions 345 of the lateral edges 303 of the top cover 300 can, but need not, extend headward as far as the footward ends of the attachment paths 335, but typically no farther; in the example of FIG. 1C the footward portion (indicated by the presence of mating zipper elements along footward portions 345 the lateral edges 303 of the top cover 300) does not extend headward as far as the attachment paths 335. The footward portion of the top cover 300 can be further arranged to enable separation of footward portions 345 of the lateral edges 303 of the top cover 300, so that the footward portion of the top cover 300 can assume a substantially flattened configuration (e.g., as in FIG. 1C). As already noted, in some examples the footward portions 345 of the lateral edges 303 of the top cover 300 can include mating zipper elements to enable those edges to be secured together or separated. In other examples, sets of mating fastener elements (e.g., snaps, clasps, buttons, hook-and-loop, ties or laces, and the like) can be employed for securing together those edge portions together (to assume the tubular configuration) or allowing them to separate (to assume a substantially flattened configuration). A footward end 347 of the top cover 300 can be further arranged to enable the footward end of the top cover 300 to be closed when it is arranged in the tubular configuration (e.g., as in FIGS. 4 and 5). The footward end of the top cover 300 can include one or more zippers, fasteners, drawstrings, or other devices or arrangements for closing the footward end 347 of the top cover 300 when it is in the tubular configuration.

The different configurations described in the preceding paragraph for the footward portion of the top cover 300 provide additional options for a user occupying the inventive sleeping bag. In cooler conditions, footward portions 345 of the top cover lateral edges 303 can be secured together so that the footward portion of the top cover 300 is arranged in the tubular configuration; the footward end 347 of the top cover 300 can also be closed, if desired. In that way the lower portions of the user's body are completely encircled by the top cover 300. In conjunction with the wrapped arrangement of the headward portion of the top cover 300, maximal warmth is provided to the user occupying the sleeping bag. In warmer conditions, or if greater freedom of movement is desired, the footward portions 345 of the top cover lateral edges 303 can be separated and the footward portion of the top cover 300 can be arranged in the flattened configuration. The lower portions of the user's body can move unconstrained by the top cover 300, and can even move out from under the top cover 300. In conjunction with the expanded configuration of the headward portion of the top cover 300, increased freedom of movement is available to the user occupying the sleeping bag. If even more freedom of movement is desired, or if a given temperature is too warm for the user's comfort beneath the top cover 300, the top cover 300 can be detached from one or both lateral flaps 220 while the user occupies the sleeping bag. Detachment of the top cover 300 from one or both lateral flaps 220 enables the user to arrange the top cover 300 to cover, or leave uncovered, any desired portions of the user's body for achieving comfort under the given temperature conditions, in a manner similar to use of traditional bedding.

In some examples, the bottom sheet 200 of the inventive sleeping bag includes a hood 240 comprising a transverse hood segment and a pair of lateral hood segments. The hood 240 is attached to the sheet portion 201 of the bottom sheet 200 so that, with the bottom sheet 200 secured to the sleeping pad 100, (i) the transverse hood segment is positioned across a headward end of the sleeping pad 100, and (ii) the lateral hood segments are positioned along corresponding headward portions of corresponding opposite lateral edges of the sleeping pad 100. In some examples, the hood 240 can act as a thermal insulator or include thermally insulating material. In cooler conditions, the hood 240 can be arranged to surround the user's head and shoulders while occupying the sleeping bag (e.g., in conjunction with the headward portion of the top cover 300 being arranged in the wrapped configuration, and with the footward portion of the top cover 300 being arranged in the tubular configuration with the footward end closed; optionally part of the headward portion of the top cover 300 can be tucked into the hood 240, e.g., as in FIG. 5). In warmer conditions, the hood 240 can be folded down to act as a pillow for the user's head (e.g., in conjunction with the headward portion of the top cover 300 being arranged in the expanded configuration and optionally folded down over the lateral flaps 220 as in FIG. 5, or partly or wholly detached from the bottom sheet 200, or with the footward portion of the top cover 300 in the flattened configuration). A separate pillow 250 can be positioned within the hood 240 on the bottom sheet 200, if desired (e.g., as in FIG. 4).

In some examples (e.g., as in FIGS. 1B, 2, 4, and 5), each lateral flap 220 can be integrally formed with a corresponding one of the lateral hood segments; one advantage of such an arrangement is a headward portion of the top cover 300 can be readily tucked into the hood 240 in cooler conditions. In other examples (e.g., as in FIGS. 7 and 8), the hood 240 and the lateral flaps 220 are separate portions of the bottom sheet 200. In such examples, each lateral flap 220 can extend in a footward direction from a corresponding footward end of the corresponding lateral hood segment. In some examples, a headward portion of each lateral flap 220 and a corresponding footward portion of the corresponding lateral hood segment overlap one another; in some of those examples, the overlapping portions of the lateral hood segments are positioned medially relative to the corresponding overlapping portions of the lateral flaps 220, to maintain thermal integrity of the sleeping bag when the lateral flaps 220 are secured to the top cover 300.

If needed or desired, one or more of the hood 240, the bottom sheet 200, or the top cover 300 can be provided with a storage pocket formed therein or thereon. Such a storage pocket can include a zipper, fastener, or other closure if needed or desired.

Any one or more materials (e.g., fabrics or insulators) suitable for constructing a conventional sleeping bag can be employed for constructing an inventive sleeping bag. Examples of such materials include, but are not limited to: nylon, polyester, silk, cotton, taffeta, ripstop, pongee, flannel, microfiber, Gore-Tex, or fleece; natural down, synthetic insulation, or other insulating material; or metal-coated polymer film or other thermally shielding or thermally reflective material. If needed or desired, one or more of the sleeping pad, bottom sheet, or top cover can include heating elements, e.g., electrical or chemical heating elements.

In addition to the preceding, the following examples fall within the scope of the present disclosure or appended claims:

Example 1

A sleeping bag comprising a top cover and a bottom sheet, wherein: (a) the bottom sheet is structurally arranged so as to be secured to a sleeping pad; (b) the bottom sheet includes a sheet portion and a pair of flexible opposing lateral flaps connected along corresponding medial edges thereof to the sheet portion so that, with the bottom sheet secured to the sleeping pad, the lateral flaps are positioned along corresponding opposite lateral edges of the sleeping pad; and (c) the top cover and the pair of lateral flaps are structurally arranged so as to enable attachment, detachment, and reattachment of each lateral flap along a corresponding lateral edge thereof to an outer surface of the top cover along a corresponding curved or linear attachment path displaced medially from a corresponding lateral edge of the top cover.

Example 2

The sleeping bag of Example 1 wherein, with the bottom sheet secured to the sleeping pad and with the lateral flaps attached to the top cover, the top cover and the bottom sheet are structurally arranged so as to enable a headward portion of the top cover, which extends in a headward direction from footward ends of the lateral flaps, (i) to assume a wrapped configuration with portions of the top cover outer surface, that are disposed laterally relative to the attachment paths, being positioned against the sheet portion of the bottom sheet; (ii) to assume an expanded configuration with each one of the lateral flaps, and laterally disposed portions of the top cover, extending upward or laterally away from the corresponding lateral edges of the sleeping pad; and (iii) to be converted between the wrapped and expanded configurations by a user occupying the sleeping bag.

Example 3

The sleeping bag of any one of Examples 1 or 2 wherein distance along each flap from the medial edge thereof to the lateral edge thereof is greater than or about equal to 4 inches, greater than or about equal to 5 inches, greater than or about equal to 6 inches, greater than or about equal to 7 inches, greater than or about equal to 9 inches, greater than or about equal to 11 inches, or even larger.

Example 4

The sleeping bag of any one of Examples 1 through 3 wherein distance along the top cover from each attachment path to the corresponding lateral edge of the top cover is greater than or about equal to 4 inches, greater than or about equal to 5 inches, greater than or about equal to 6 inches, greater than or about equal to 7 inches, greater than or about equal to 9 inches, greater than or about equal to 11 inches, or even larger.

Example 5

The sleeping bag of any one of Examples 1 through 4 wherein distance along the top cover from each attachment path to the corresponding lateral edge of the top cover is greater than or about equal to distance along each flap from the medial edge thereof to the lateral edge thereof.

Example 6

The sleeping bag of any one of Examples 1 through 5 wherein, with the bottom sheet secured to the sleeping pad, each lateral flap extends in a footward direction no further than about a midpoint of the sleeping pad.

Example 7

The sleeping bag of any one of Examples 1 through 6 wherein, with the bottom sheet secured to the sleeping pad, neither lateral flap extends in a headward direction as far as a headward end of the sleeping pad.

Example 8

The sleeping pad of any one of Examples 1 through 7 wherein the top cover acts as a thermal insulator or includes thermally insulating material.

Example 9

The sleeping pad of any one of Examples 1 through 8 wherein the sleeping pad acts as a thermal insulator or includes thermally insulating material.

Example 10

The sleeping bag of any one of Examples 1 through 9 further comprising the sleeping pad.

Example 11

The sleeping bag of Example 10 wherein the bottom sheet and the sleeping pad are integrally formed.

Example 12

The sleeping bag of any one of Examples 1 through 10 wherein sheet portion of the bottom sheet is arranged so as to be secured to the sleeping pad in a fitted-sheet arrangement.

Example 13

The sleeping bag of Example 12 wherein the bottom sheet includes one or more straps arranged so that, with the sheet portion of the bottom sheet secured to the sleeping pad in the fitted-sheet arrangement, each one of the one or more straps is connected to opposite edges of the sheet portion and passes underneath the sleeping pad.

Example 14

The sleeping bag of any one of Examples 1 through 13 wherein the bottom sheet includes a hood comprising a transverse hood segment and a pair of lateral hood segments and is attached to the sheet portion of the bottom sheet so that, with the sheet portion of the bottom sheet secured to the sleeping pad, (i) the transverse hood segment is positioned across a headward end of the sleeping pad, and (ii) the lateral hood segments are positioned along corresponding headward portions of corresponding opposite lateral edges of the sleeping pad.

Example 15

The sleeping bag of Example 14 wherein each lateral flap is integrally formed with a corresponding one of the lateral hood segments.

Example 16

The sleeping bag of any one of Examples 14 or 15 wherein each lateral flap extends in a footward direction from a corresponding footward end of the corresponding lateral hood segment.

Example 17

The sleeping bag of any one of Examples 14 or 16 wherein a headward portion of each lateral flap and a corresponding footward portion of the corresponding lateral hood segment overlap one another.

Example 18

The sleeping bag of any one of Examples 14 through 17 wherein the hood acts as a thermal insulator or includes thermally insulating material.

Example 19

The sleeping bag of any one of Examples 1 through 18 wherein the top cover and the bottom sheet include corresponding mating zipper elements arranged so as to enable the attachment, detachment, and reattachment of each lateral flap along the corresponding lateral edge thereof to the outer surface of the top cover along the corresponding curved or linear attachment path.

Example 20

The sleeping bag of any one of Examples 1 through 19 wherein the top cover and the bottom sheet include corresponding sets of mating fastener elements arranged so as to enable the attachment, detachment, and reattachment of each lateral flap along the corresponding lateral edge thereof to the outer surface of the top cover along the corresponding curved or linear attachment path.

Example 21

The sleeping bag of any one of Examples 1 through 20 wherein a footward portion of the top cover is structurally arranged so as to enable the footward portion of the top cover to assume a tubular configuration with corresponding footward portions of opposite lateral edges of the top cover secured together.

Example 22

The sleeping bag of Example 21 wherein the top cover includes corresponding mating zipper elements arranged along the footward portions of the opposite lateral edges of the top cover so as to enable (i) the footward portion of the top cover to assume the tubular configuration with the footward portions of the lateral edges secured together, and (ii) the footward portions of the lateral edges of the top cover to be detached from each other and thereby enable the footward portion of the top cover to assume a substantially flattened configuration.

Example 23

The sleeping bag of any one of Examples 21 or 22 wherein the top cover includes corresponding sets of mating fastener elements arranged along the footward portions of the opposite lateral edges of the top cover so as to enable (i) the footward portion of the top cover to assume the tubular configuration with the footward portions of the lateral edges secured together, and (ii) the footward portions of the lateral edges of the top cover to be detached from each other and thereby enable the footward portion of the top cover to assume a substantially flattened configuration.

Example 24

The sleeping bag of any one of Examples 21 through 23 wherein a footward end of the top cover is structurally arranged so as to enable, with the footward portion of the top cover in the tubular configuration, the footward end of the top cover to be closed.

Example 25

The sleeping bag of Example 24 wherein the footward end of the top cover includes one or more zippers, fasteners, or drawstrings arranged so as to enable, with the footward portion of the top cover in the tubular configuration, the footward end of the top cover to be closed.

Example 26

The sleeping bag of any one of Examples 21 through 25 wherein the footward portion of the top cover extends headward at least a far as footward ends of the connection paths.

Example 27

The sleeping bag of any one of Examples 1 through 26 further comprising a pillow positioned within the hood.

Example 28

The sleeping bag of any one of Examples 1 through 27 further comprising a storage pocket formed in or on the hood, the bottom sheet, or the top cover.

Example 29

A method for using the sleeping bag of any one of Examples 1 through 28, the method comprising: (A) with the bottom sheet secured to the sleeping pad, attaching each lateral flap along the corresponding lateral edge thereof to the outer surface of the top cover along the corresponding attachment path so that a user occupying the sleeping bag is at least partly enclosed by the bottom sheet and the top cover; and one or both of: (B) with the lateral flaps attached to the top cover, arranging a headward portion of the top cover, which extends in a headward direction from footward ends of the lateral flaps, to assume a wrapped configuration with portions of the top cover outer surface that are disposed laterally relative to the attachment paths being positioned against the sheet portion of the bottom sheet underneath the user; or (C) with the lateral flaps attached to the top cover, arranging the headward portion of the top cover to assume an expanded configuration with each one of the lateral flaps, and laterally disposed portions of the top cover, extending upward and laterally away from the corresponding lateral edges of the sleeping pad.

Example 30

The method of Example 29 for using the sleeping bag of any one of Examples 2 through 28, the method further comprising, with the lateral flaps attached to the top cover and the user occupying the sleeping bag, converting the top cover from the wrapped configuration to the expanded configuration or from the expanded configuration to the wrapped configuration.

Example 31

The method of any one of Examples 29 or 30 for using the sleeping bag of any one of Examples 1 through 28, the method further comprising, with the lateral flaps attached to the top cover and the user occupying the sleeping bag, detaching one or both flaps from the top cover.

Example 32

The method of any one of Examples 29 through 31 for using the sleeping bag of any one of Examples 12 through 28, the method further comprising, before part (A), securing the bottom sheet to the sleeping pad in a fitted-sheet arrangement.

Example 33

The method of any one of Examples 29 through 32 for using the sleeping bag of any one of Examples 21 through 28, the method further comprising arranging a footward portion of the top cover to assume a tubular configuration with corresponding footward portions of opposite lateral edges of the top cover secured together.

Example 34

The method of any one of Examples 29 through 33 for using the sleeping bag of any one of Examples 24 through 28, the method further comprising, with the footward portion of the top cover in the tubular configuration, closing a footward end of the top cover.

Example 35

The method of any one of Examples 29 through 34 for using the sleeping bag of any one of Examples 22 through 28, the method further comprising arranging a footward portion of the top cover to assume a substantially flattened configuration with corresponding footward portions of opposite lateral edges of the top cover separated from one another.

It is intended that equivalents of the disclosed example embodiments and methods shall fall within the scope of the present disclosure or appended claims. It is intended that the disclosed example embodiments and methods, and equivalents thereof, may be modified while remaining within the scope of the present disclosure or appended claims.

In the foregoing Detailed Description, various features may be grouped together in several example embodiments for the purpose of streamlining the disclosure. This method of disclosure is not to be interpreted as reflecting an intention that any claimed embodiment requires more features than are expressly recited in the corresponding claim. Rather, as the appended claims reflect, inventive subject matter may lie in less than all features of a single disclosed example embodiment. Thus, the appended claims are hereby incorporated into the Detailed Description, with each claim standing on its own as a separate disclosed embodiment. However, the present disclosure shall also be construed as implicitly disclosing any embodiment having any suitable set of one or more disclosed or claimed features (i.e., a set of features that are neither incompatible nor mutually exclusive) that appear in the present disclosure or the appended claims, including those sets that may not be explicitly disclosed herein. In addition, for purposes of disclosure, each of the appended dependent claims shall be construed as if written in multiple dependent form and dependent upon all preceding claims with which it is not inconsistent. It should be further noted that the scope of the appended claims does not necessarily encompass the whole of the subject matter disclosed herein.

For purposes of the present disclosure and appended claims, the conjunction "or" is to be construed inclusively (e.g., "a dog or a cat" would be interpreted as "a dog, or a cat, or both"; e.g., "a dog, a cat, or a mouse" would be interpreted as "a dog, or a cat, or a mouse, or any two, or all three"), unless: (i) it is explicitly stated otherwise, e.g., by use of "either . . . or," "only one of," or similar language; or (ii) two or more of the listed alternatives are mutually exclusive within the particular context, in which case "or" would encompass only those combinations involving non-mutually-exclusive alternatives. For purposes of the present disclosure and appended claims, the words "comprising," "including," "having," and variants thereof, wherever they appear, shall be construed as open ended terminology, with the same meaning as if the phrase "at least" were appended after each instance thereof, unless explicitly stated otherwise. For purposes of the present disclosure or appended claims, when terms are employed such as "about equal to," "substantially equal to," "greater than about," "less than about," and so forth, in relation to a numerical quantity, standard conventions pertaining to measurement precision and significant digits shall apply, unless a differing interpretation is explicitly set forth. For null quantities described by phrases such as "substantially prevented," "substantially absent," "substantially eliminated," "about equal to zero," "negligible," and so forth, each such phrase shall denote the case wherein the quantity in question has been reduced or diminished to such an extent that, for practical purposes in the context of the intended operation or use of the disclosed or claimed apparatus or method, the overall behavior or performance of the apparatus or method does not differ from that which would have occurred had the null quantity in fact been completely removed, exactly equal to zero, or otherwise exactly nulled.

For purposes of the present disclosure and appended claims, any labelling of elements, steps, limitations, or other portions of an embodiment, example, or claim (e.g., first, second, etc., (a), (b), (c), etc., or (i), (ii), (iii), etc.) is only for purposes of clarity, and shall not be construed as implying any sort of ordering or precedence of the portions so labelled. If any such ordering or precedence is intended, it will be explicitly recited in the embodiment, example, or claim or, in some instances, it will be implicit or inherent based on the specific content of the embodiment, example, or claim. In the appended claims, if the provisions of 35 USC § 112(f) are desired to be invoked in an apparatus claim, then the word "means" will appear in that apparatus claim. If those provisions are desired to be invoked in a method claim, the words "a step for" will appear in that method claim. Conversely, if the words "means" or "a step for" do not appear in a claim, then the provisions of 35 USC § 112(f) are not intended to be invoked for that claim.

If any one or more disclosures are incorporated herein by reference and such incorporated disclosures conflict in part or whole with, or differ in scope from, the present disclosure, then to the extent of conflict, broader disclosure, or broader definition of terms, the present disclosure controls. If such incorporated disclosures conflict in part or whole with one another, then to the extent of conflict, the later-dated disclosure controls.

The Abstract is provided as required as an aid to those searching for specific subject matter within the patent literature. However, the Abstract is not intended to imply that any elements, features, or limitations recited therein are necessarily encompassed by any particular claim. The scope of subject matter encompassed by each claim shall be determined by the recitation of only that claim.

What is claimed is:

1. A sleeping bag assembly for use by a user, the sleeping bag assembly comprising:

a bottom sheet defining a sheet portion, which is sized and shaped to underlie the user when using the sleeping bag, and two opposing lateral bottom sheet edges, the bottom sheet being configured to be selectively secured to a sleeping pad, the bottom sheet including a hood comprising a transverse hood segment and a pair of lateral hood segments for surrounding the user's head and shoulders while occupying the sleeping bag;

an insultated top cover defining two opposing lateral cover edges, the top cover having an outer surface adapted to face away from the user when occupying the sleeping bag assembly, and an inner surface adapted to face the user when occupying the sleeping bag assembly, the top cover having a greater lateral extent than the bottom sheet;

a first lateral flap coupled to one of the lateral bottom sheet edges of the bottom sheet along a first bottom sheet attachment path and releasably coupled to the outer surface of the top cover along a first cover attachment path, the first cover attachment path extending longitudinally along the outer surface of the top cover and being displaced medially inboard from one of the lateral cover edges, the first lateral flap having a greater longitudinal extent than the first cover attachment path; and a second lateral flap coupled to the other one of the lateral bottom sheet edges of the bottom sheet along a second bottom sheet attachment path and releasably coupled to the outer surface of the top cover along a second cover attachment path, the second cover attachment path extending longitudinally along the outer surface of the top cover and being displaced medially inboard from the other one of the lateral cover edges, the second lateral flap having a greater longitudinal extent than the second cover attachment path;

wherein the sleeping bag assembly is selectively configurable from a sleeping bag configuration and a quilt configuration, the top cover being completely separated and removed from the bottom sheet in the quilt configuration such that the top cover can be used independently of the bottom sheet as a quilt;

in the sleeping bag configuration, the top cover being attached to the bottom sheet via the first and second lateral flaps along both the first and second cover attachment paths to define an interior chamber of the sleeping bag sized and shaped for receiving the user of the sleeping bag assembly, a headward portion of the top cover extending above the first and second cover attachment paths, the headward portion being selectively moveable between a wrapped configuration and an expanded configuration while the user occupies the interior chamber of the sleeping bag, lateral side portions of the top cover being defined as the portion of the top cover located between the first and second cover attachment paths and the respective lateral cover edge, each of the lateral side portions of the top cover having a lateral extent greater than the respective first and second lateral flap such that, in the sleeping bag configuration, the lateral side portions can be arranged to at least partially underlie a part of the user when the user is occupying the interior chamber of the sleeping bag assembly, and a footward portion of the top cover being selectively configurable to define a closed footbox of the sleeping bag assembly and an opened footbox of the sleeping bag assembly.

2. The sleeping bag assembly as set forth in claim 1 wherein each of the first and second lateral flaps are insulated.

3. The sleeping bag assembly as set forth in claim 1 wherein both the first and second cover attachment paths are generally linear.

4. The sleeping bag assembly as set forth in claim 3 wherein the top cover defines a headward end and a footward end spaced longitudinally from the headward end, both the first and second cover attachment paths being spaced from the headward end and the footward end.

5. The sleeping bag assembly as set forth in claim 4 wherein both the first and second cover attachment paths taper inward.

6. The sleeping bag assembly as set forth in claim 1, wherein the first and second lateral flaps are releasably coupled to the outer surface of the top cover by slide fasteners.

7. The sleeping bag assembly as set forth in claim 1 further comprising a sleeping pad.

8. A sleeping bag assembly for use by a user, the sleeping bag assembly comprising:

a bottom sheet defining a sheet portion, which is sized and shaped to underlie the user when using the sleeping bag, and two opposing lateral bottom sheet edges, the bottom sheet being configured to be selectively secured to a sleeping pad;

a top cover defining two opposing lateral cover edges, the top cover having an outer surface adapted to face away from the user when occupying the sleeping bag assembly, and an inner surface adapted to face the user when occupying the sleeping bag assembly, the top cover having a greater lateral extent than the bottom sheet;

a first lateral flap attached to the bottom sheet along a first sheet attachment path and releasably coupled to the outer surface of the top cover along a first cover attachment path, and a second lateral flap spaced from the first lateral flap and attached to the bottom sheet along a second sheet attachment path and releasably coupled to the outer surface of the top cover along a second cover attachment path, wherein the sleeping bag assembly is selectively configurable from a sleeping bag configuration and a quilt configuration, the top cover being completely separated and removed from the bottom sheet in the quilt configuration such that the top cover can be used independently of the bottom sheet as a quilt;

in the sleeping bag configuration, the top cover being attached to the bottom sheet via the first and second lateral flaps along both the first and second cover attachment paths to define an interior chamber of the sleeping bag sized and shaped for receiving the user of the sleeping bag assembly;

lateral side portions of the top cover being defined as the portion of the top cover located between the first and second cover attachment paths and the respective lateral cover edge, each of the lateral side portions of the top cover having a lateral extent greater than 6 inches, the lateral side portions can be arranged to at least partially underlie a part of the user when the user is occupying the interior chamber of the sleeping bag assembly.

9. The sleeping bag assembly as set forth in claim 8 wherein the first and second sheet attachment paths are displaced medially inward from each of the lateral sheet edges.

10. The sleeping bag assembly as set forth in claim 8 wherein both the first and second cover attachment paths are generally linear.

11. The sleeping bag assembly as set forth in claim 10 wherein the top cover defines a headward end and a footward end spaced longitudinally from the headward end, both the first and second cover attachment paths being spaced inward from the headward end and the footward end.

12. The sleeping bag assembly as set forth in claim 8 further comprising a sleeping pad for underlying the bottom sheet.

13. The sleeping bag assembly as set forth in claim 12 wherein the sleeping pad defines opposite lateral sleeping pad edges, each of the first and second sheet attaching paths being generally aligned with one of the lateral sleeping pad edges when the sleeping pad is placed under the bottom sheet.

14. The sleeping bag assembly as set forth in claim 8 wherein each of the first and second lateral flaps has a transverse distance greater than or about equal to 4 inches.

15. The sleeping bag assembly as set forth in claim 14 wherein each of the first and second lateral flaps has a transverse distance greater than or about equal to 9 inches.

16. The sleeping bag assembly as set forth in claim 8 wherein the top cover comprises thermal insulating material and the bottom sheet is free from thermal insulating material.

17. The sleeping bag assembly as set forth in claim 8 wherein the top cover comprise an upper half and a lower half, the first and second cover attachment paths being located in the upper half of the top cover, the lower half of the top cover being free of the first and second cover attachment paths.

18. A sleeping bag assembly for use by a user, the sleeping bag assembly comprising:

a bottom sheet;

a top cover defining an inner surface, an outer surface, a headward end, a footward end, and two opposing lateral cover edges extending from the headward end to the footward end;

a first lateral flap attached to the bottom sheet along a first sheet attachment path and releasably coupled to the outer surface of the top cover along a first cover attachment path, and a second lateral flap spaced from the first lateral flap and attached to the bottom sheet along a second sheet attachment path and releasably coupled to the outer surface of top cover along a second cover attachment path the sleeping bag assembly being selectively configurable from a sleeping bag configuration and a quilt configuration, the top cover being completely separated and removed from the bottom sheet in the quilt configuration such that the top cover can be used independently of the bottom sheet as a quilt;

in the sleeping bag configuration, the top cover being attached to the bottom sheet via the first and second lateral flaps along both the first and second cover attachment paths to define an interior chamber of the sleeping bag sized and shaped for receiving the user of the sleeping bag assembly, lateral side portions of the top cover being defined as the portion of the top cover located between the first and second cover attachment paths and the respective lateral cover edge, each of the lateral side portions of the top cover having a lateral extent greater than 6 inches and configured to at least partially underlie a part of the user when the user is occupying the interior chamber of the sleeping bag assembly.

19. The sleeping bag assembly as set forth in claim 18 wherein the sleeping bag assembly being selectively moveable between a reduced-girth configuration and an increased-girth configuration.

20. The sleeping bag assembly as set forth in claim 18 wherein the top cover comprise an upper half and a lower half, the first and second cover attachment paths being located in the upper half of the top cover, the lower half of the top cover being selectively configurable between an opened footbox and a closed footbox.

21. A sleeping bag assembly for use by a user, the sleeping bag assembly comprising:

a bottom sheet defining a sheet portion, which is sized and shaped to underlie the user when using the sleeping bag, and two opposing lateral bottom sheet edges, the bottom sheet being configured to be selectively secured to a sleeping pad;

an insultated top cover defining two opposing lateral cover edges, the top cover having an outer surface adapted to face away from the user when occupying the sleeping bag assembly, and an inner surface adapted to face the user when occupying the sleeping bag assembly, the top cover having a greater lateral extent than the bottom sheet;

a first lateral flap coupled to one of the lateral bottom sheet edges of the bottom sheet along a first bottom sheet attachment path and releasably coupled to the outer surface of the top cover along a first cover attachment path, the first cover attachment path extending longitudinally along the outer surface of the top cover and being on the outer surface of the top cover and displaced medially inboard from one of the lateral cover edges, the first lateral flap being releasably coupled to the outer surface of the top cover; and a second lateral flap coupled to the other one of the lateral bottom sheet edges of the bottom sheet along a second bottom sheet attachment path and releasably coupled to the outer surface of the top cover along a second cover attachment path, the second cover attachment path extending longitudinally along the outer surface of the top cover and being located on the outer surface of the top cover and displaced medially inboard from the other one of the lateral cover edges, the second lateral flap being releasably coupled to the outer surface of the top cover;

wherein the sleeping bag assembly is selectively configurable from a sleeping bag configuration and a quilt configuration, the top cover being completely separated and removed from the bottom sheet in the quilt configuration such that the top cover can be used independently of the bottom sheet as a quilt;

in the sleeping bag configuration, the top cover being attached to the first and second lateral flaps along both the first and second cover attachment paths to define an interior chamber of the sleeping bag sized and shaped for receiving the user of the sleeping bag assembly, lateral side portions of the top cover being defined as the portion of the top cover located between the first and second cover attachment paths and the respective lateral cover edge, each of the lateral side portions of the top cover having a lateral extent greater than the respective first and second lateral flap such that, in the sleeping bag configuration, the lateral side portions can be arranged to at least partially underlie a part of the user when the user is occupying the interior chamber of the sleeping bag assembly.

* * * * *